US010502512B1

(12) United States Patent
Beaudry

(10) Patent No.: US 10,502,512 B1
(45) Date of Patent: Dec. 10, 2019

(54) FIREARM MUZZLE ACCESSORY

(71) Applicant: Smith & Wesson Corp., Springfield, MA (US)

(72) Inventor: Grey Beaudry, Boise, ID (US)

(73) Assignee: Smith & Wesson Inc., Springfield, MA (US)

( * ) Notice: Subject to any disclaimer, the term of this patent is extended or adjusted under 35 U.S.C. 154(b) by 0 days.

(21) Appl. No.: 16/110,777

(22) Filed: Aug. 23, 2018

(51) Int. Cl.
*F41A 21/30* (2006.01)
*F41A 21/28* (2006.01)
*F41A 21/34* (2006.01)
*F41A 21/32* (2006.01)

(52) U.S. Cl.
CPC ..... *F41A 21/30* (2013.01); *F41A 21/28* (2013.01); *F41A 21/325* (2013.01); *F41A 21/34* (2013.01)

(58) Field of Classification Search
CPC ..... F41A 21/30; F41A 21/28; F41A 21/325; F41A 21/34
USPC ..... 89/14.4; 181/223
See application file for complete search history.

(56) References Cited

U.S. PATENT DOCUMENTS

| | | | | | |
|---|---|---|---|---|---|
| 1,667,186 | A * | 4/1928 | Bluehdorn | F41A 21/30 | 89/14.3 |
| 3,500,955 | A * | 3/1970 | Werbell | F41A 21/30 | 181/223 |
| 3,667,570 | A * | 6/1972 | WerBell, III | F41A 21/30 | 181/223 |
| 5,029,512 | A * | 7/1991 | Latka | F41A 21/30 | 181/223 |
| 8,910,745 | B2 | 12/2014 | Latka | | |
| 10,060,695 | B2 * | 8/2018 | Slack | F41A 21/30 | |
| 2005/0001066 | A1 * | 1/2005 | Miyamoto | B05B 1/02 | 239/461 |
| 2017/0205174 | A1 * | 7/2017 | Petersen | F41A 21/30 | |
| 2018/0292160 | A1 * | 10/2018 | Petersen | F41A 21/28 | |
| 2018/0313624 | A1 * | 11/2018 | Smith | F41A 21/30 | |

* cited by examiner

*Primary Examiner* — Samir Abdosh
(74) *Attorney, Agent, or Firm* — Stinson LLP

(57) ABSTRACT

A gas diffuser for a firearm muzzle accessory such as a firearm sound suppressor, flash hider, or muzzle brake. The gas diffuser includes a diffuser baffle extending helically around the projectile passage. A firearm sound suppressor including the gas diffuser can include a housing and gas baffling inside the housing downstream from the gas diffuser.

21 Claims, 12 Drawing Sheets

FIREARM MUZZLE ACCESSORY

FIELD

The present disclosure generally relates to firearm accessories, and more particularly to firearm muzzle accessories.

BACKGROUND

Various firearm muzzle accessories exist for connection to a muzzle of a firearm. For example, firearm suppressors are connectable to a muzzle of a firearm to reduce sound emitted when a shot is fired from the firearm. Other firearm muzzle accessories include muzzle brakes, flash hiders, and suppressor mounts.

SUMMARY

In one aspect, a firearm sound suppressor includes a firearm connector constructed for connecting the firearm sound suppressor to a firearm. The firearm sound suppressor includes a housing supported by the firearm connector. The housing has a proximal end and a distal end opposite the proximal end. A projectile passage extends between the proximal and distal ends of the housing through which a projectile can pass along a projectile axis through the firearm suppressor. Gas baffling supported by the housing includes a diffuser body. The diffuser body includes a diffuser baffle extending helically around the projectile passage. The diffuser baffle bounds a slot extending helically around the projectile passage. The diffuser body includes an opening extending helically around the projectile passage and permitting gas flow from the projectile passage to enter the helical slot.

In another aspect, a firearm muzzle accessory includes a firearm connector constructed for connecting the firearm accessory to a firearm. The firearm muzzle accessory includes a diffuser body supported by the firearm connector. The diffuser body has a projectile passage through which a projectile can pass along a projectile axis through the diffuser body. The diffuser body includes a diffuser baffle extending helically around the projectile passage. The diffuser baffle bounds a slot extending helically around the projectile passage. The diffuser body includes an opening extending helically around the projectile passage and permitting gas flow from the projectile passage to enter the helical slot.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
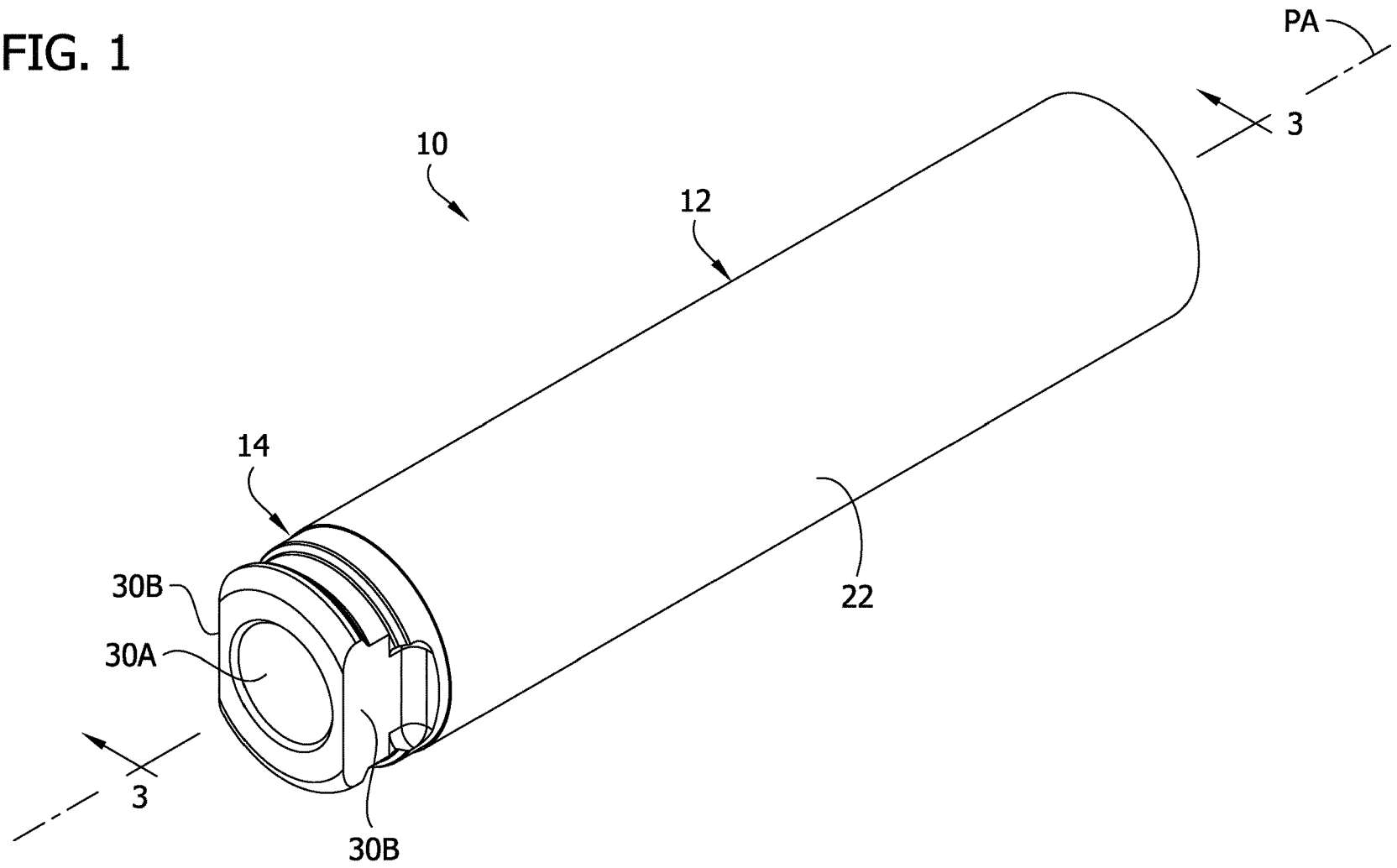
FIG. 1 is a perspective of a firearm sound suppressor of the present disclosure.
Figure 2:
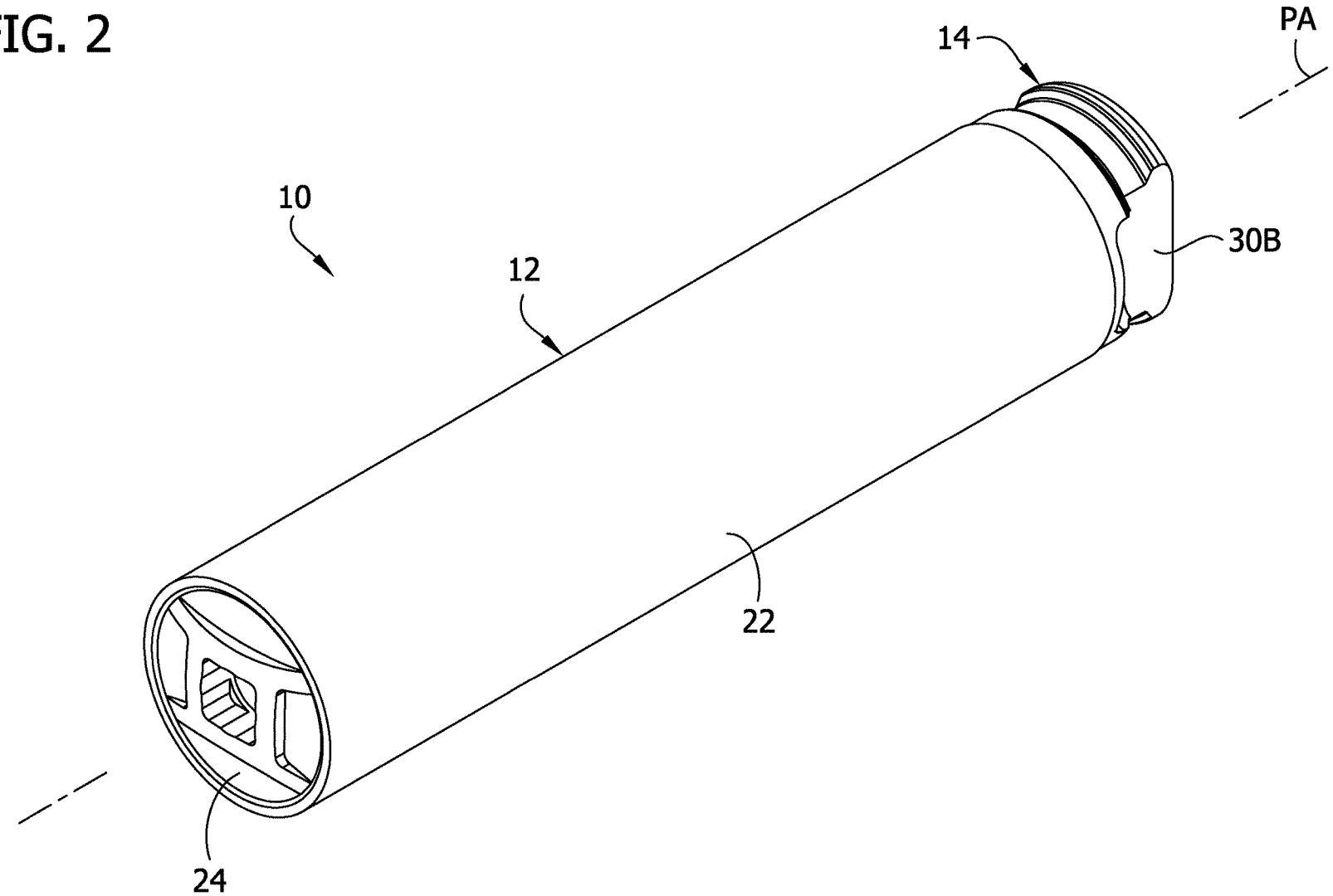
FIG. 2 is another perspective of the firearm sound suppressor.

Referring to FIGS. 1 and 2, a firearm sound suppressor (broadly, "firearm muzzle accessory") of the present disclosure is designated generally by the reference number 10. The suppressor is configured to be mounted on a firearm. A projectile (e.g., bullet) can be fired from the firearm through a projectile passage 11 (FIG. 3) of the suppressor extending along a projectile axis PA. The suppressor 10 is configured to reduce sound heard when the firearm is fired by reducing pressure and/or velocity of propellant gases from a muzzle of the firearm before the gases are emitted to the surrounding environment from the suppressor.

Figure 3:
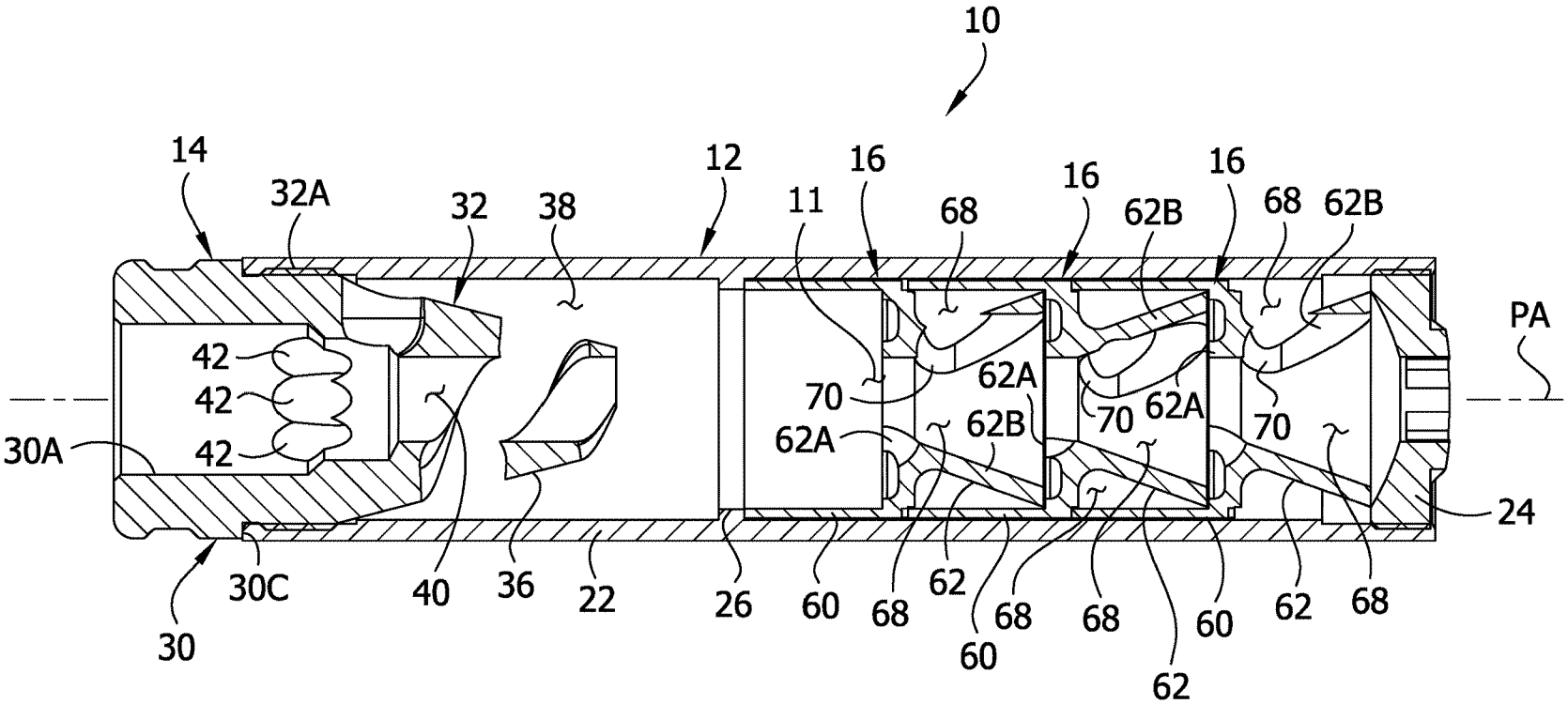
FIG. 3 is a section of the firearm sound suppressor taken in a plane including line 3-3 of FIG. 1.

Referring to FIGS. 1-3, the suppressor 10 generally includes a housing 12, a diffuser 14, and a plurality of baffle cups 16. As will become apparent, when a shot is fired through the suppressor 10, propellant gases passing through the suppressor are diffused by the diffuser 14 before passing through the baffle cups 16 and out of the housing 12. The diffuser 14 is believed to create a turbulent flow of gas upstream from the baffle cups 16 that results in improved reduction of gas pressure and/or velocity before the gas passes through the baffle cups. Other arrangements can be used without departing from the scope of the present invention.

The housing 12 includes a sleeve 22 and an end cap 24. In the illustrated embodiment, the sleeve 22 has a generally cylindrical tubular shape. The sleeve 22 has a proximal end including an internally threaded opening into which the diffuser 14 is threaded. The sleeve 22 has a distal end including an internally threaded opening into which the end cap 24 is threaded. The sleeve 22 includes an internal annular rib 26 (FIG. 3) for locating the baffle cups 16 in the housing 12. The end cap 24 is threadably receivable in the distal threaded opening of the sleeve 22 to close a distal end of the sleeve to maintain the baffle cups 16 in the housing. The housing 12 (and other components of the suppressor 10) can be made of aluminum or another suitable material. Housings having other configurations can be used without departing from the scope of the present invention. For example, end cap 24 can be formed as one piece with the sleeve 22. Moreover, the housing 12 can be at least partially formed by portions of the baffle cups 16 (e.g., in a construction where the baffle cups are threaded to each other and there is no outer tube surrounding the baffle cups).

The diffuser 14 includes a proximal base 30 and a distal diffuser body 32. The base 30 has an internally threaded opening 30A configured to thread onto a threaded muzzle of a firearm. Thus, in the illustrated embodiment, the base 30 of the diffuser 14 defines a firearm connector of the suppressor 10. The diffuser base 30 includes two wrench flats 30B on opposing sides of the diffuser base for engagement by a wrench or other tool to assist with installation and removal of the suppressor 10. It will be appreciated that the firearm connector can be connected to a barrel adapter or other intermediate component for connection to the firearm muzzle rather than being directly connected to the firearm muzzle. Other types of firearm connectors (e.g., non-threaded, quick connect, etc.) can be used, and the firearm connector can be formed separately from the diffuser 14, without departing from the scope of the present invention.

Figure 4:
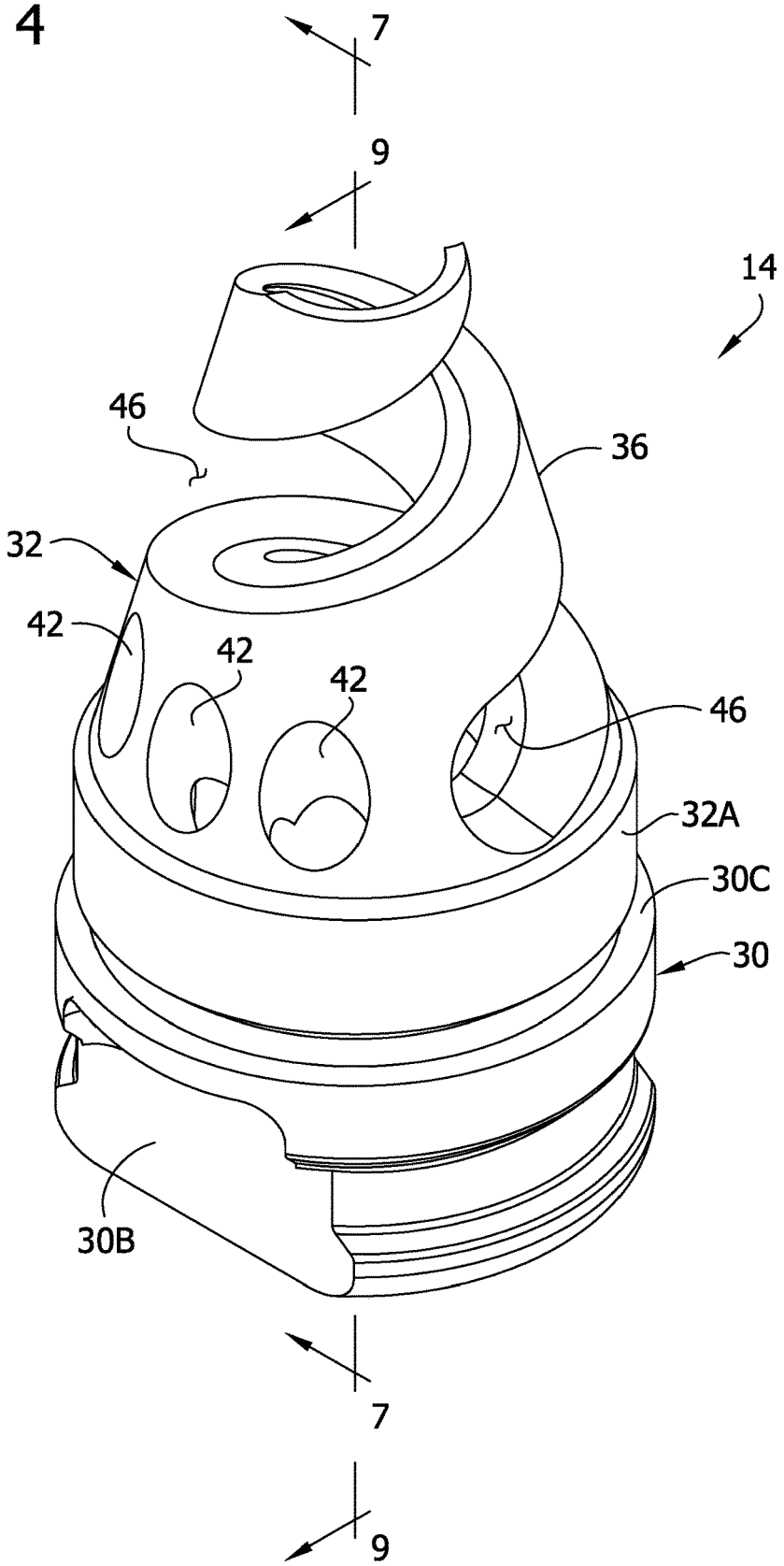
FIG. 4 is a front perspective of a diffuser of the firearm sound suppressor.

The diffuser body 32 includes a proximal portion having an external thread 32A for threaded connection with the threaded opening at the proximal end of the sleeve 22. An external shoulder 30C of the diffuser base 30 abuts the housing 12 and locates the diffuser 14 with respect to the housing. Referring now also to FIG. 4, the diffuser body 32 includes a distal portion having an outer surface shaped generally as a truncated cone. The diffuser body 32 includes a diffuser baffle 36 that extends helically around the projectile passage 11 and that defines the distal portion of the diffuser body. The diffuser baffle 36 is located in a diffuser chamber 38 in the housing 12. Desirably, the diffuser baffle 36 extends helically around at least one quarter of the circumference of the projectile passage 11, more desirably at least one half of the circumference of the projectile passage, more desirably at least three quarters of the circumference of the projectile passage, and even more desirably at least a full circumference of the projectile passage 11. In the illustrated embodiment, the diffuser baffle extends helically around more than one full circumference of the projectile passage 11.

Figure 7:
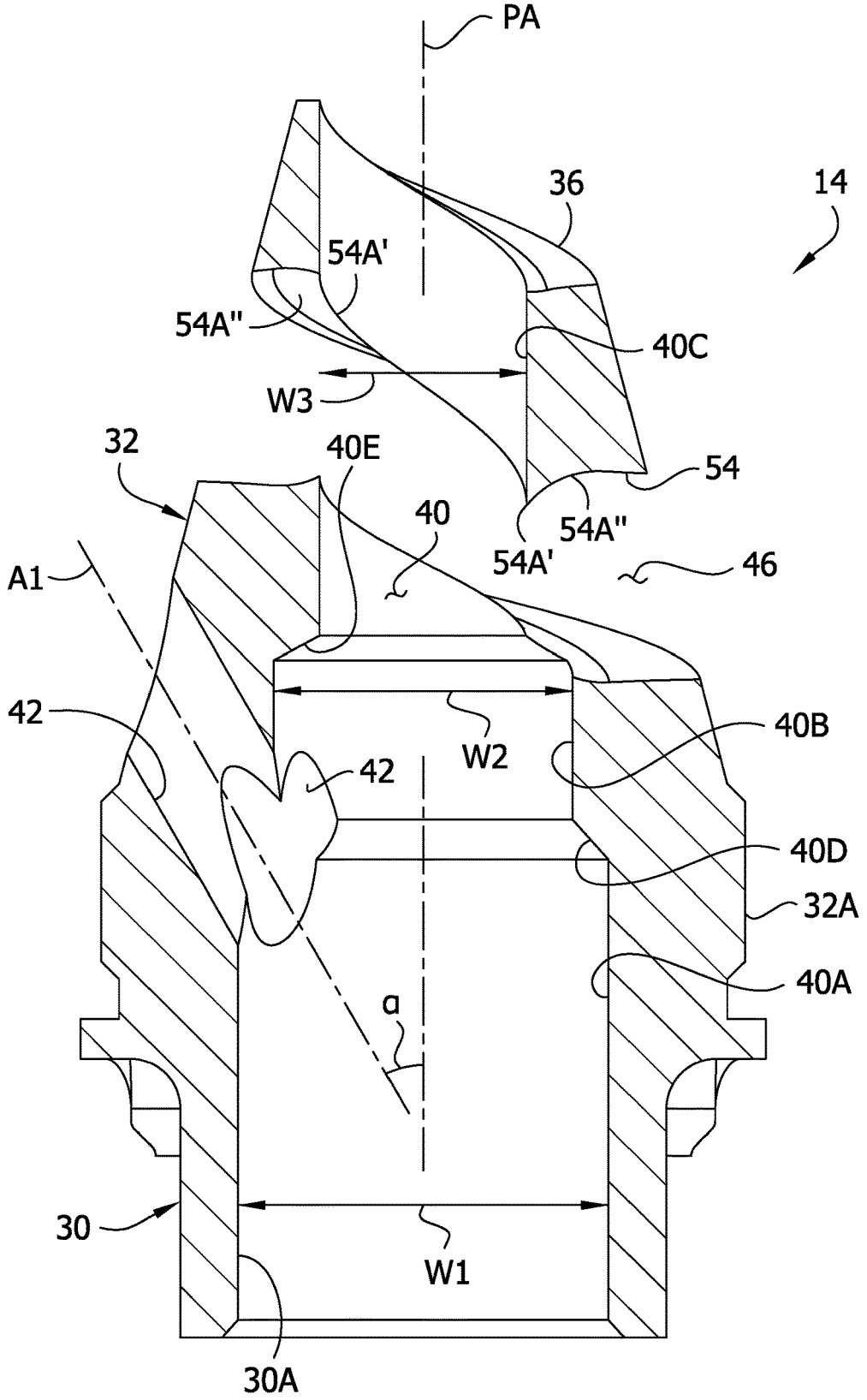
FIG. 7 is a section of the diffuser taken in a plane including line 7-7 of FIG. 4.
Figure 8:
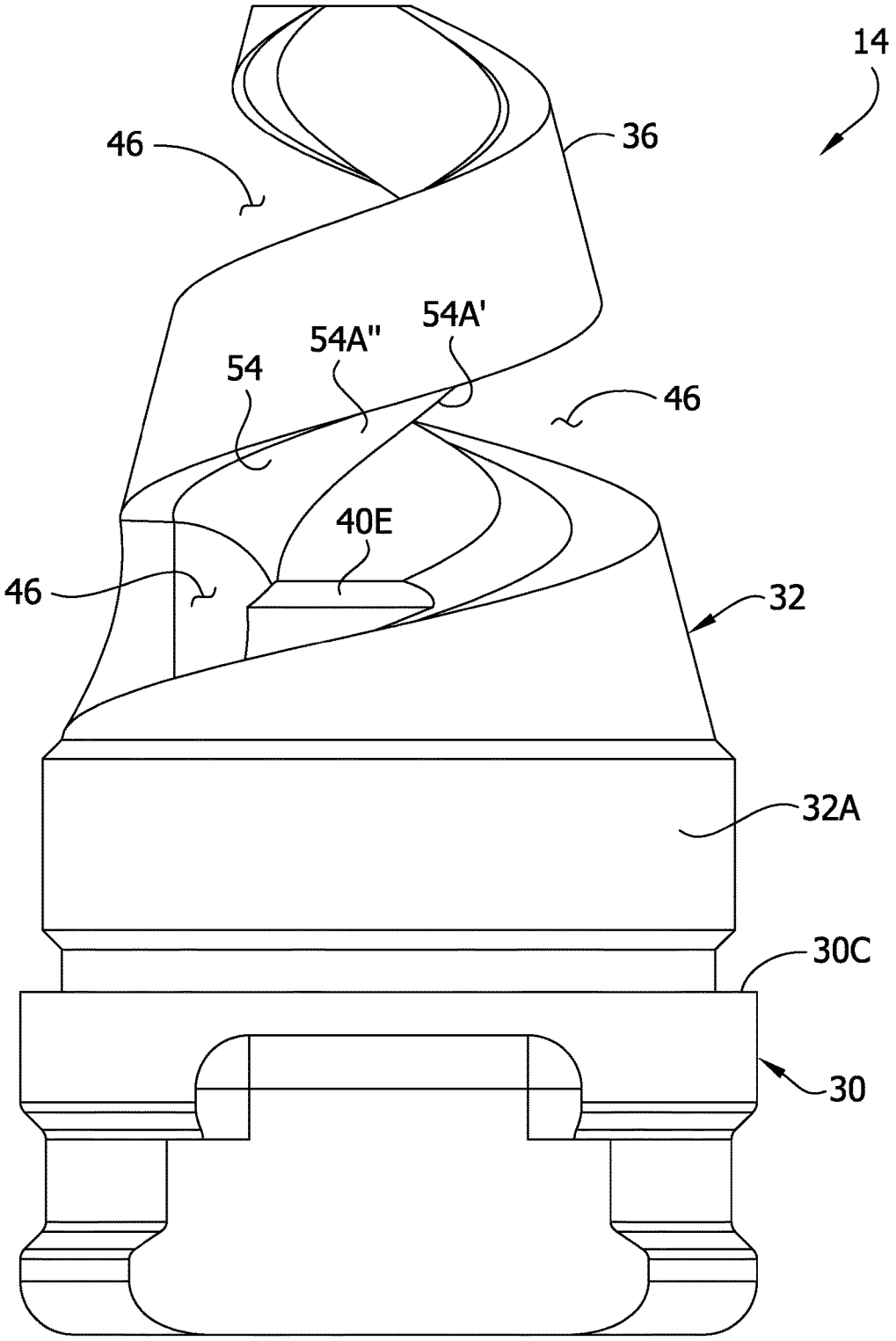
FIG. 8 is a rear elevation of the diffuser.
Figure 9:
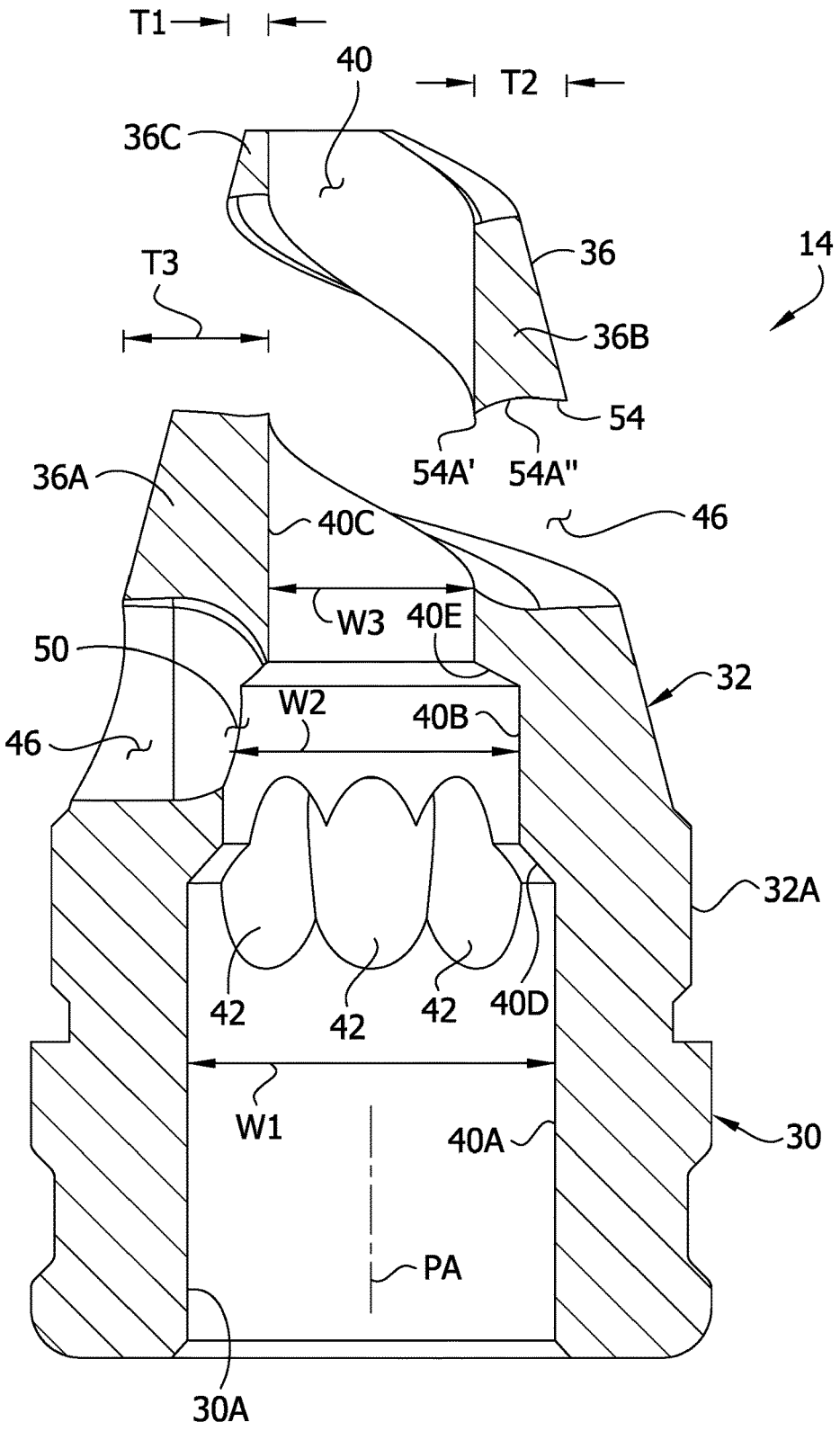
FIG. 9 is a section of the diffuser taken in a plane including line 9-9 of FIG. 4.
Figure 10:
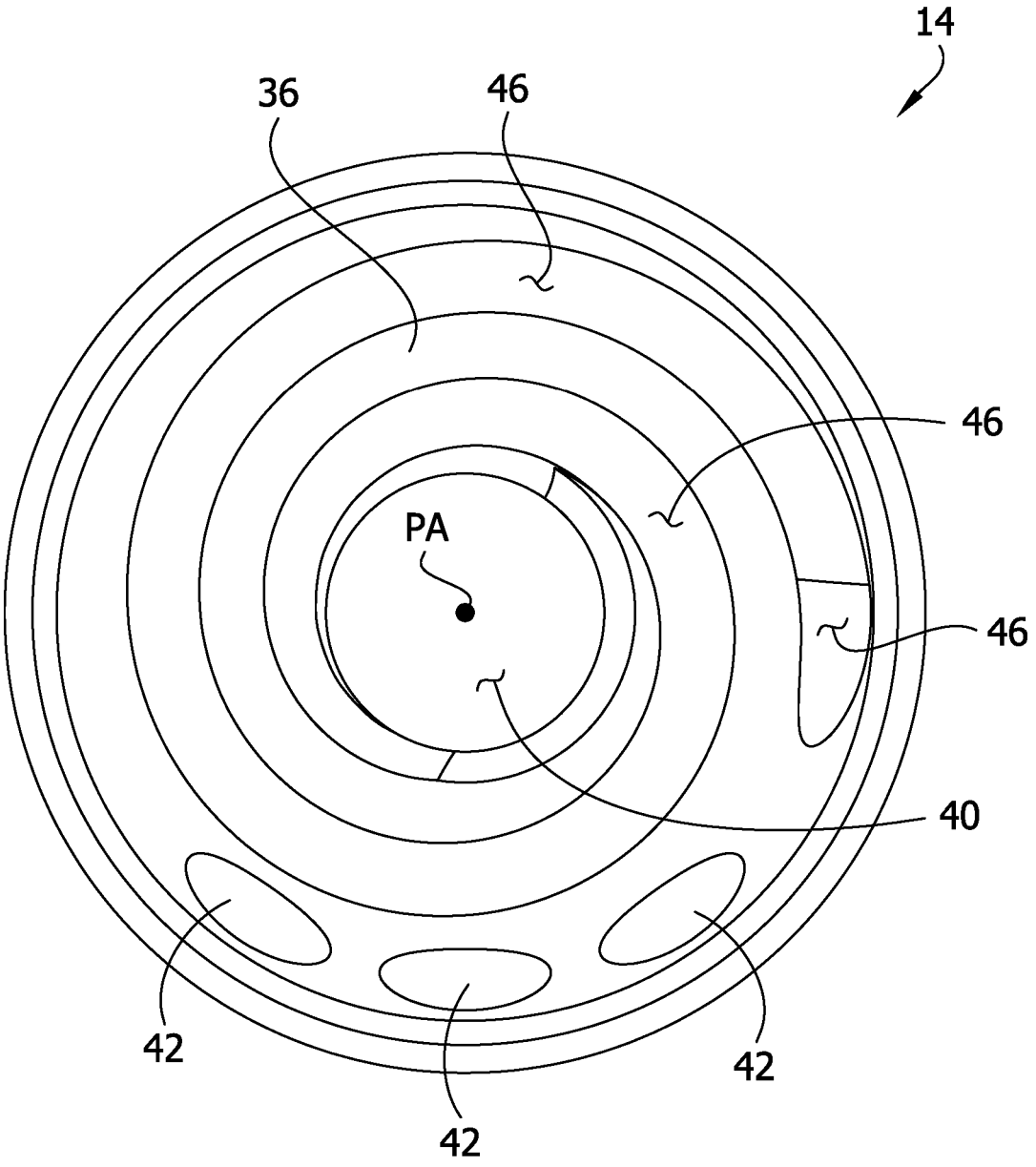
FIG. 10 is a distal end view of the diffuser.

The diffuser body includes a diffuser passage 40 that extends along the projectile axis PA and forms part of the projectile passage 11 through the suppressor 10. Referring to FIGS. 7 and 9, the diffuser passage 40 begins with a relatively wide first portion 40A having a width W1 similar to the threaded opening 30A of the diffuser base 30. The diffuser passage 40 includes a second portion 40B distal from the first portion 40A that has a width W2 less than the width W1 of the first portion. The diffuser passage 40 includes a third portion 40C distal from the second portion 40B that has a width W3 less than the width W2 of the second portion. The first, second, and third portions 40A, 40B, 40C are generally cylindrical and are separated by first and second shoulders 40D, 40E. The first shoulder 40D tapers from the width W1 of the first diffuser passage portion 40A to the width W2 of the second diffuser passage portion 40B. The second shoulder 40E tapers from the width W2 of the second diffuser passage portion 40B to the width W3 of the third diffuser passage portion 40C.

The proximal portion of the diffuser body 32 includes three ports 42 extending through the diffuser body from the diffuser passage 40 to the diffuser chamber 38. The three ports 42 have inlets inside the diffuser body 32 at the first shoulder 40D of the diffuser passage 40 and that extend proximally and distally from the first shoulder into the first and second portions 40A, 40B of the diffuser passage 40. The reduction in diameter of the diffuser passage 40 at the first shoulder 40D assists in causing gas to flow into the inlets of the ports 42. In the illustrated embodiment, the port inlets are joined, but the port outlets on the outer surface of the diffuser body 32 are spaced from each other. The ports 42 extend along respective port axes A1 (only one being shown, in FIG. 7) extending at an angle $\alpha$ (e.g., in the inclusive range of 5 to 50 degrees, more desirably in the inclusive range of 15 to 45 degrees, such as about 30 degrees) with respect to the projectile axis PA, laterally from the projectile axis and distally away from the firearm connector. As the ports 42 extend from the joined inlets away from the projectile axis PA, the ports 42 diverge from each other before terminating in the separate outlets.

Figure 5:
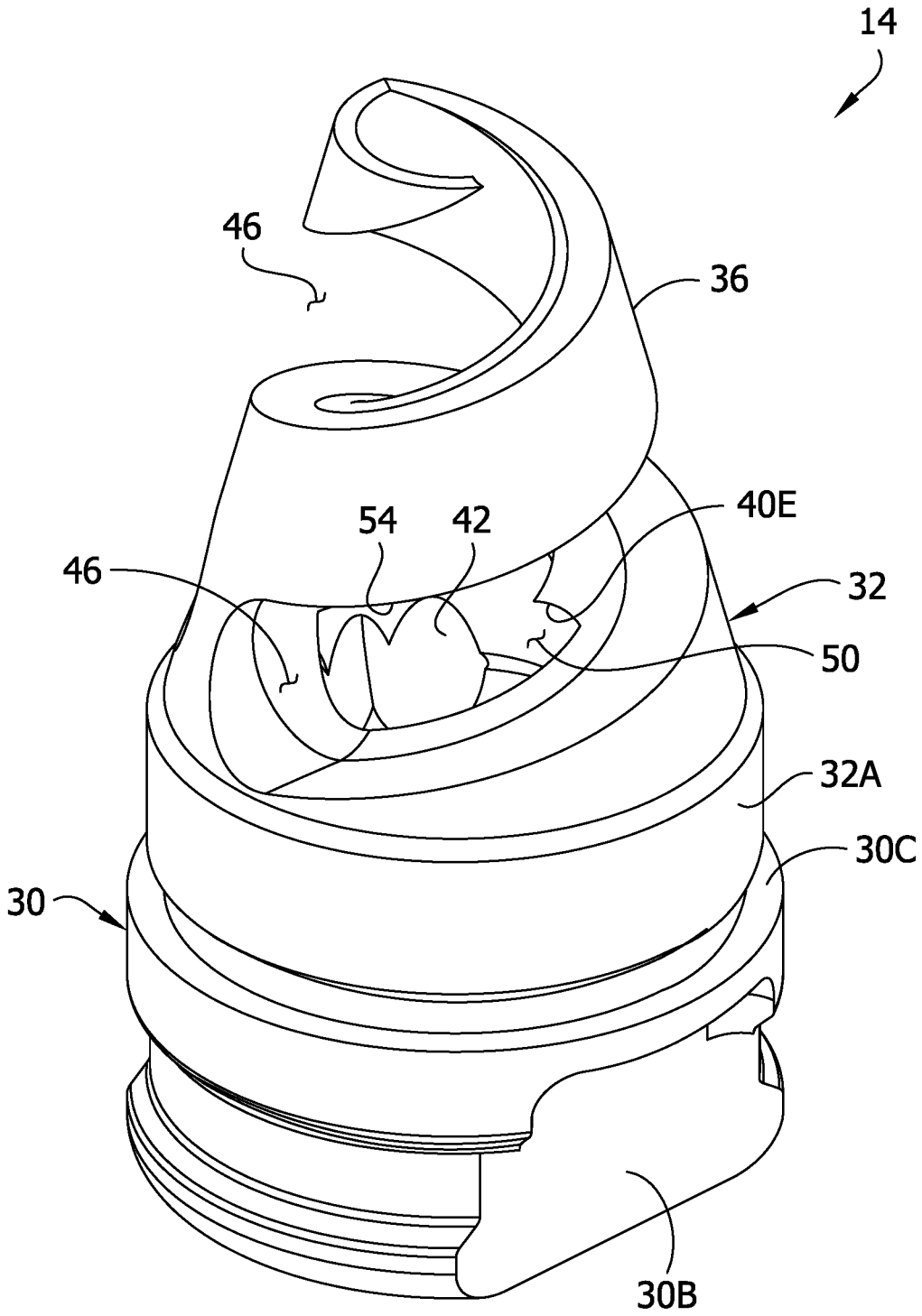
FIG. 5 is a rear perspective of the diffuser.
Figure 6:
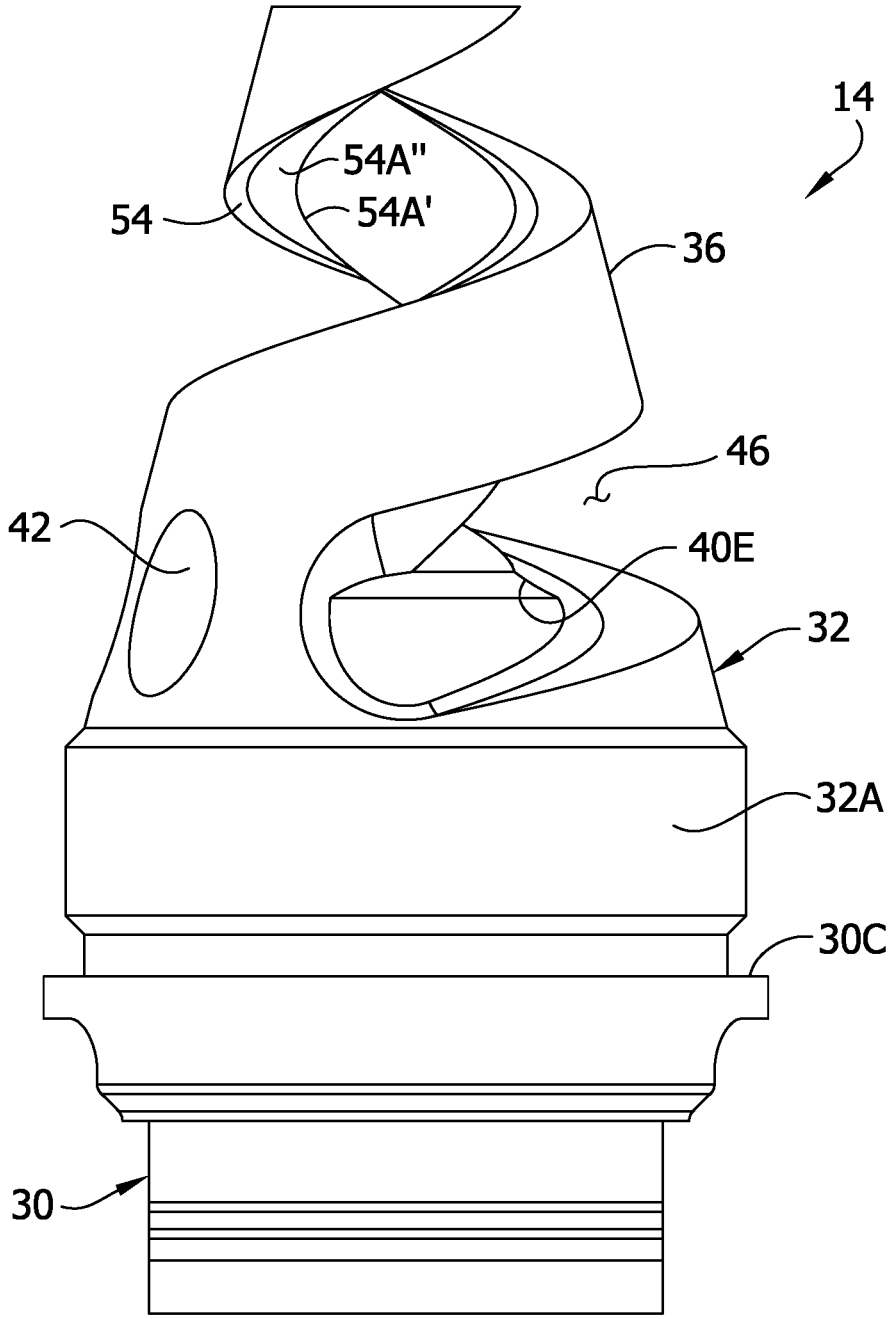
FIG. 6 is a right side elevation of the diffuser.
Figure 11:
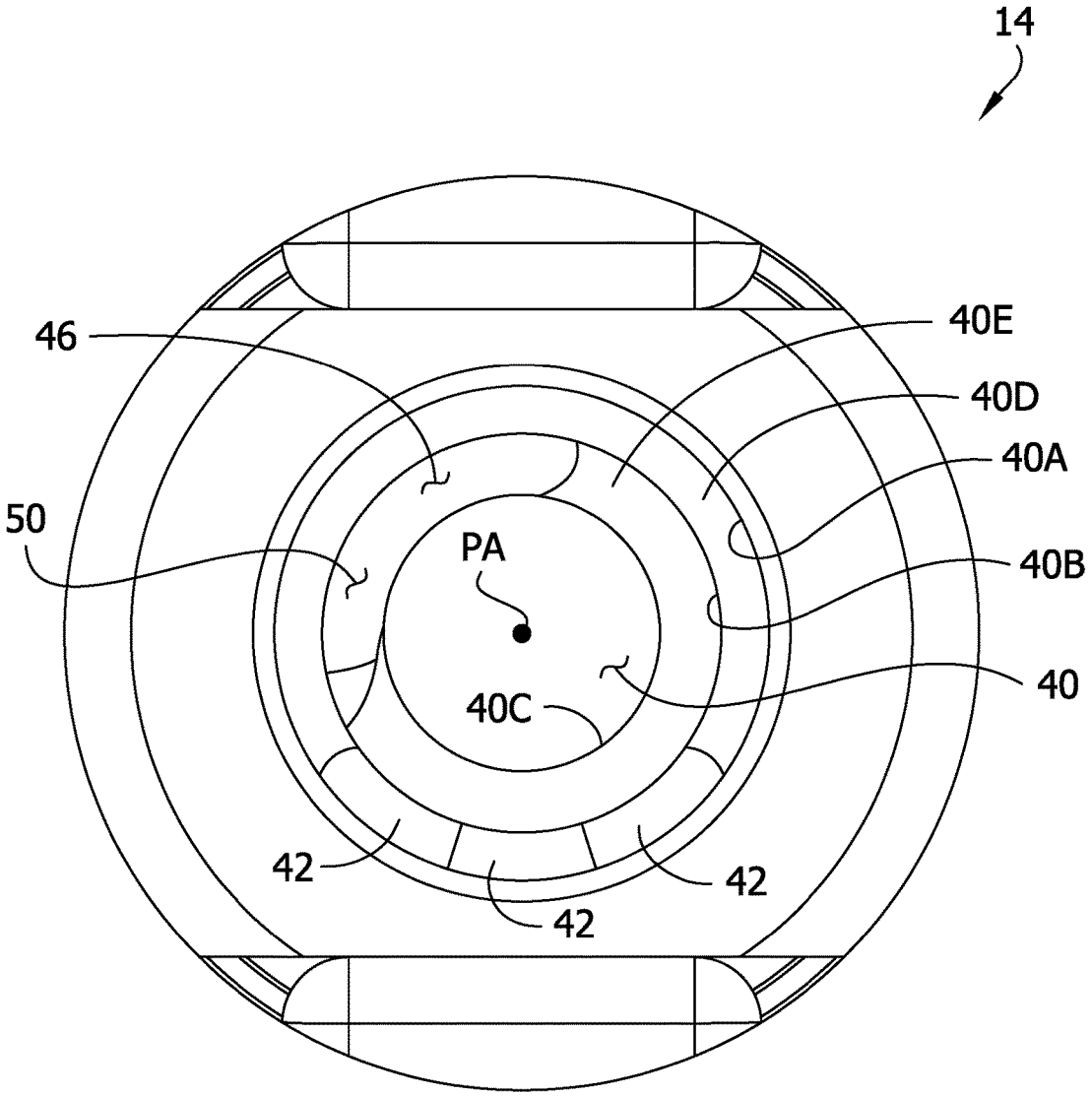
FIG. 11 is a proximal end view of the diffuser.

The helical diffuser baffle 36 bounds a slot 46 extending helically around the projectile passage. The helical slot 46 extends helically around more than the full circumference of the diffuser passage 40 to an open distal end of the slot at the distal end of the diffuser body 32. A proximal end of the slot 46 is open to the diffuser passage 40 at the second shoulder 40E in the diffuser passage 40 and proximally and distally in the second and third diffuser passage portions 40B, 40C from the second shoulder. The diffuser body includes a helical opening defining a helical entrance for flow of gas from the projectile passage to the helical slot 46. In the illustrated embodiment, the slot 46 opens into the projectile passage along its full extent, but other configurations (e.g., segmented or discontinuous helical opening, etc.) can be used without departing from the scope of the present invention. Moreover, the slot 46 can be segmented or discontinuous (e.g., having slot portions separated from each other) without departing from the scope of the present invention. Distally from the proximal end of the slot 46, the slot is open to the third portion 40C of the diffuser passage 40 via the helical opening. The arrangement is such that the helical slot 46 defines a conical helical gas flow path having an entrance or mouth 50 (FIGS. 5, 9, and 11) at the proximal portion of the slot 46, at the intersection of the slot with the second portion 40B of the diffuser passage 40 and the second shoulder 40E of the diffuser passage. Restriction of the gas flow passage by the shoulder 40E assists in promoting gas flow into the mouth 50. Moreover, the mouth 50 is oriented to capture some gas flowing down the diffuser passage 40 in a direction generally parallel to the projectile axis PA. Gas that enters the helical slot 46 at the entrance 50 desirably follows the helical gas flow path for at least a short distance to direct the gas in the generally spiral pattern. Downstream from the proximal end of the helical slot 46, gas can enter the helical slot laterally from the third portion 40C of the diffuser passage 40 through the helical opening between the projectile passage and the helical slot. The diffuser baffle 36 has a helical proximally facing surface 54 that guides gas flowing distally along the helical gas flow path. The helical proximally facing surface 54 of the diffuser baffle 36 is shaped to direct gas laterally from the projectile passage 11 as the gas flows helically around the gas flow passage. In particular, the diffuser baffle 36 has an acutely angled inner edge 54A' pointing proximally and extending along the helical diffuser baffle 36, and immediately outboard of the inner edge, a concave curved surface 54A" for turning gas laterally away from the projectile axis PA. The arrangement is such that gas emits from the helical slot 46 generally in the form of a spiral radiating from the projectile axis PA and extending distally. It will be appreciated that the slot 46 can have other configurations without departing from the scope of the present invention.

It will be appreciated that the diffuser baffle 36 reduces in cross-sectional size as the diffuser baffle extends helically around the projectile passage 11. For example, referring to FIG. 9, the diffuser baffle 36 is shown in section at a proximal segment 36A of the diffuser baffle, at an intermediate segment 36B of the diffuser baffle, and at a distal segment 36C of the diffuser baffle. The cross sections are taken in a plane in which the projectile axis PA lies. Measured transverse to the projectile axis PA, a thickness T1 of the distal segment 36C of the diffuser baffle 36 is less than a thickness T2 of the intermediate segment 36B of the diffuser baffle, which is less than a thickness T3 of the proximal segment 36A of the diffuser baffle. In the illustrated embodiment, the cross-sectional size of the diffuser baffle 36 (and the thickness of the diffuser baffle) smoothly tapers as the diffuser baffle extends helically around the projectile passage 11. Other constructions can be used without departing from the scope of the present invention.

Gas exiting the ports 42, gas exiting the helical slot 46, and gas exiting the distal end of the diffuser 14 desirably mixes turbulently inside the diffuser chamber 38 to reduce the pressure and/or velocity of the gas. The gas exiting the ports 42 and the gas exiting the helical slot 46 desirably is directed laterally to collide with the inside surface of the sleeve 22. The collision of the gas with the inside surface of the sleeve 22 is believed to cause the gas to be redirected inward and to collide with the column of gas passing along the projectile axis PA from the distal end of the diffuser 14. Desirably, this disrupts gas from flowing directly down the projectile axis PA to exit the suppressor 10 and improves turbulence generated downstream in the baffle cups 16.

Figure 12:
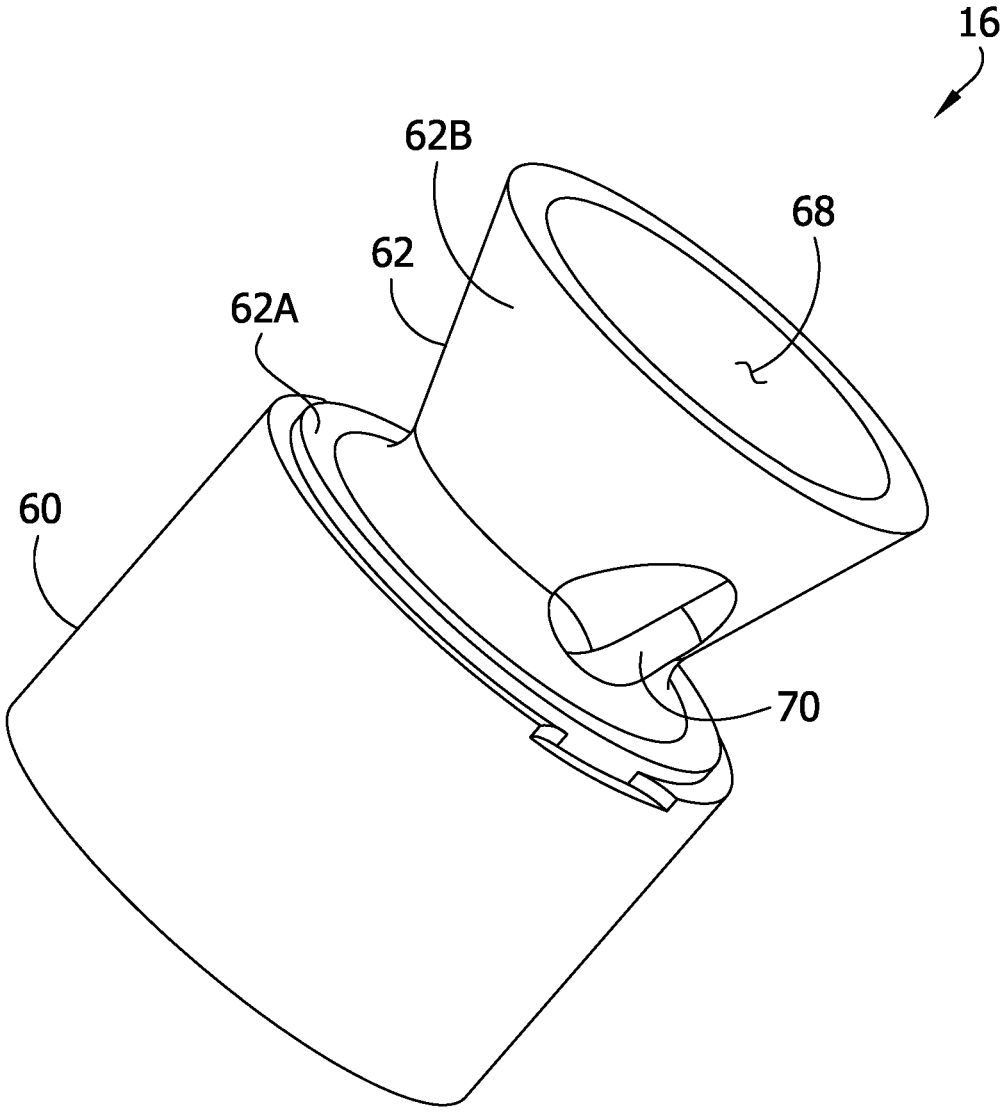
FIG. 12 is a perspective of a baffle cup of the firearm sound suppressor.

As shown in FIGS. 3 and 12, the baffle cups 16 each include a generally cylindrical spacer wall 60 and a baffle wall 62. Each baffle wall 62 includes a radially inward extending, first segment 62A generally transverse to the projectile axis PA, and a bell-shaped second segment 62B extending distally from the first segment. The baffle cups 16 are constructed such that the bell-shaped second segment 62B of one baffle cup 16 fits inside the spacer wall 60 of an adjacent baffle cup. A proximal end of the spacer wall 60 of the proximal most baffle cup 16 abuts the internal rib 26 in the housing 12. The nested baffle cups 16 are retained in the housing by the end cap 24, as explained above. The baffle walls 62 of the baffle cups 16 separate the interior of the housing 12 into a plurality of gas expansion chambers 68 downstream from the diffuser chamber 38. Openings 70 are provided in the baffle walls 62 to permit flow of gas through the baffle walls. The gas expansion chambers 68 are designed to further decrease the pressure and/or velocity of the gas in the suppressor 10 before the gas is emitted from the suppressor. It will be appreciated that other types of baffle cups or other types of baffle walls can be used without departing from the scope of the present invention.

In view of the above description, it will be understood that the suppressor 10 has gas baffling including the diffuser body 32 and the baffle walls 62 of the baffle cups 16. Other arrangements and types of gas baffling can be used without departing from the scope of the present invention. For example, the gas baffling could include baffle walls formed as part of a "monocore" instead of baffle cups.

It will be appreciated that the diffuser body 32 described above can be incorporated in other firearm muzzle accessories without departing from the scope of the present invention. For example, a muzzle brake, a flash hider, a suppressor mount, or other type of firearm muzzle accessory can include the diffuser body 32 or the diffuser baffle 36 described above or variations thereof. In one example, the diffuser 14 described above can be used apart from the other components of the suppressor 10 as a muzzle brake and/or flash hider. It will be appreciated that in such a case, the diffuser body 32 would work to diffuse gas in a similar fashion as described above, except the gas would be diffused to ambient rather than into the diffuser chamber 38 of the suppressor 10. The diffuser body 32 or diffuser baffle 36 can be implemented in other ways in a firearm muzzle accessory.

In a method of using the suppressor 10, the user connects the suppressor to a firearm. When the user fires the firearm, the projectile travels through the projectile passage 11 along the projectile axis PA through the suppressor 10. Propellant gases also travel through the suppressor 10 along the projectile passage 11. The gas is diffused into the diffuser chamber 38 and then passes through the plurality of baffle cups 16. The gas exits the suppressor 10 through the end cap 24 at lower velocity and with less pressure than when the gas entered the suppressor.

It will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A firearm sound suppressor for use with a firearm, the firearm sound suppressor comprising:

a firearm connector constructed for connecting the firearm sound suppressor to the firearm;

a housing supported by the firearm connector, the housing having a proximal end and a distal end opposite the proximal end;

a projectile passage extending between the proximal and distal ends of the housing through which a projectile can pass along a projectile axis through the firearm suppressor;

gas baffling supported by the housing, the gas baffling including a diffuser body, the diffuser body including a diffuser baffle extending helically around the projectile passage, the diffuser baffle bounding a slot extending helically around the projectile passage, the diffuser body including an opening extending helically around the projectile passage and permitting gas flow from the projectile passage to enter the helical slot.

2. A firearm sound suppressor as set forth in claim 1, wherein the gas baffling includes a plurality of baffle walls located distally from the diffuser baffle, the plurality of baffle walls separating a plurality of gas expansion chambers located distally from the diffuser baffle.

3. A firearm sound suppressor as set forth in claim 2, wherein the diffuser baffle is in a diffuser chamber located proximally from the gas expansion chambers.

4. A firearm sound suppressor as set forth in claim 3, wherein the diffuser baffle is shaped and arranged to diffuse gas laterally from the projectile passage into the diffuser chamber in a generally spiral pattern radiating from and extending along the projectile axis.

5. A firearm sound suppressor as set forth in claim 3, wherein the diffuser body reduces from a first width transverse to the projectile axis to a second width transverse to the projectile axis as the diffuser body extends distally in the diffuser chamber, the second width being less than the first width.

6. A firearm sound suppressor as set forth in claim 1, wherein the diffuser baffle extends helically around at least half of the circumference of the projectile passage.

7. A firearm sound suppressor as set forth in claim 1, wherein the diffuser baffle has a first thickness transverse to the projectile axis at a proximal segment of the diffuser baffle, and the diffuser baffle has a second thickness transverse to the projectile axis at a distal segment of the diffuser baffle, the second thickness being less than the first thickness.

8. A firearm sound suppressor as set forth in claim 7, wherein the thickness of the diffuser baffle reduces from the first thickness to the second thickness as the diffuser baffle extends helically around the projectile axis.

9. A firearm sound suppressor as set forth in claim 1, wherein the diffuser body has an outer surface having a generally conical shape reducing in width transvers to the projectile axis as the diffuser body extends distally.

10. A firearm sound suppressor as set forth in claim 9, wherein the diffuser body has a generally cylindrical passage around which the diffuser baffle extends, the generally cylindrical passage forming part of the projectile passage.

11. A firearm sound suppressor as set forth in claim 10, wherein the diffuser body defines a helical gas flow path at least partially in the slot extending helically around the projectile passage, the helical gas flow path having an axial entrance for entry of gas from the projectile passage into the helical gas flow path in a direction generally parallel to the projectile axis.

12. A firearm sound suppressor as set forth in claim 1, wherein the diffuser body includes at least one gas port different than the helical slot, the gas port extending from the projectile passage through the diffuser body to an outlet of the port on an outer surface of the diffuser body.

13. A firearm muzzle accessory for diffusing gas emitted from a muzzle of a firearm, the firearm muzzle accessory comprising:

a firearm connector constructed for connecting the firearm accessory to the firearm;

a diffuser body supported by the firearm connector, the diffuser body having a projectile passage through which a projectile can pass along a projectile axis through the diffuser body, the diffuser body including a diffuser baffle extending helically around the projectile passage, the diffuser baffle bounding a slot extending helically around the projectile passage, the diffuser body including an opening extending helically around the projectile passage and permitting gas flow from the projectile passage to enter the helical slot.

14. A firearm muzzle accessory as set forth in claim 13, wherein the diffuser baffle is shaped and arranged to diffuse gas laterally from the projectile passage in a generally spiral pattern radiating from and extending along the projectile axis.

15. A firearm muzzle accessory as set forth in claim 13, wherein the diffuser baffle has a first thickness transverse to the projectile axis at a proximal segment of the diffuser baffle, and the diffuser baffle has a second thickness transverse to the projectile axis at a distal segment of the diffuser baffle, the second thickness being less than the first thickness.

16. A firearm muzzle accessory as set forth in claim 15, wherein the thickness of the diffuser baffle reduces from the first thickness to the second thickness as the diffuser baffle extends helically around the projectile axis.

17. A firearm muzzle accessory as set forth in claim 13, wherein the diffuser body has an outer surface having a generally conical shape reducing in width transverse to the projectile axis as the diffuser body extends distally.

18. A firearm muzzle accessory as set forth in claim 17, wherein the diffuser body has a generally cylindrical passage around which the diffuser baffle extends, the generally cylindrical passage forming part of the projectile passage.

19. A firearm muzzle accessory as set forth in claim 18, wherein the diffuser body defines a helical gas flow path at least partially in the slot extending helically around the projectile passage, the helical gas flow path having an axial entrance for entry of gas from the projectile passage into the helical gas flow path in a direction generally parallel to the projectile axis.

20. A firearm muzzle accessory as set forth in claim 13, wherein the diffuser baffle extends helically around at least half of the circumference of the projectile passage.

21. A firearm muzzle accessory as set forth in claim 13, wherein the diffuser body includes at least one gas port different than the helical slot, the gas port extending from the projectile passage through the diffuser body to an outlet of the port on an outer surface of the diffuser body.

* * * * *